United States Patent [19]

Lips et al.

[11] Patent Number: 4,714,019

[45] Date of Patent: Dec. 22, 1987

[54] INSERTS FOR COATING AN EXPLOSIVE CHARGE, AND FORMING A ROD-SHAPED PROJECTILE, AND PROCESS FOR MANUFACTURE OF INSERTS

[75] Inventors: Hendrik Lips; Joerg Peters, both of Duesseldorf, Fed. Rep. of Germany

[73] Assignee: Rheinmetall GmbH, Duesseldorf, Fed. Rep. of Germany

[21] Appl. No.: 886,903

[22] Filed: Jul. 16, 1986

[30] Foreign Application Priority Data

Jul. 18, 1985 [DE] Fed. Rep. of Germany ..... 3525613

[51] Int. Cl.[4] ..... F42B 1/02

[52] U.S. Cl. ..... 102/307; 102/309; 102/331; 102/288; 102/289

[58] Field of Search ..... 102/288, 289, 290, 331, 102/307, 309

[56] References Cited

U.S. PATENT DOCUMENTS

| | | | |
|---|---|---|---|
| 3,429,264 | 2/1969 | Oversohl et al. | 102/288 |
| 3,722,421 | 3/1973 | Thrailkill et al. | 102/290 X |
| 3,745,199 | 7/1973 | Anderson et al. | 102/290 X |
| 3,765,177 | 10/1973 | Ritchey et al. | 102/290 X |
| 3,926,697 | 12/1975 | Humbert et al. | 102/288 X |
| 4,408,534 | 10/1983 | Araki et al. | 102/288 X |
| 4,594,945 | 6/1986 | Alexandris | 102/290 X |

FOREIGN PATENT DOCUMENTS

| | | | |
|---|---|---|---|
| 2234465 | 6/1973 | France | 102/289 |

*Primary Examiner*—Peter A. Nelson

[57] ABSTRACT

A flat disk having differing material properties in the inner and outer regions, resulting in varying dynamic material behavior during explosion deformation and a process for making the same. In particular, the outer regions of the flat disk produced, have a greater material hardness than the central regions of the disk.

8 Claims, 4 Drawing Figures

INSERTS FOR COATING AN EXPLOSIVE CHARGE, AND FORMING A ROD-SHAPED PROJECTILE, AND PROCESS FOR MANUFACTURE OF INSERTS

DESCRIPTION OF PRIOR ARTS

An insert of the same type is disclosed in the German Pat. No. 33 17 352. This disclosure is intended to ensure the hexagonal flaring out of a projectile by regional differences in the wall strengths of the inserts. A disadvantage of the inserts described in the above patent, is the damaging material separation which is not justified because of its high manufacturing expense.

SUMMARY OF THE PRESENT INVENTION

The object of the present invention is to provide an insert of the same type as noted above which does not have the damaging materials separation, and a process for its manufacture which is much more cost effective.

Accordingly, the object is met by the present invention wherein an insert is designed in which different material hardness is used in the different regions of the walls of the insert.

This improved disk is produced by first hardening a disk, and then pressing the flat disk into a hollow spherical cap or calotte, and then annealizing the different regions of the disk. The steps of pressing and annealizing the disk can be interchanged. The disk can also be produced by first annealizing a flat disk, having an excess diameter and wall thickness, then cold work hardening designated regions, next, preparing the disk to a specific size, and then finally pressing it into a hollow spherical cap or calotte. The cold work hardening is accomplished by either pressing the disk from the top, the bottom, or from both sides simultaneously.

DETAILED SPECIFICATION

Figure 1:
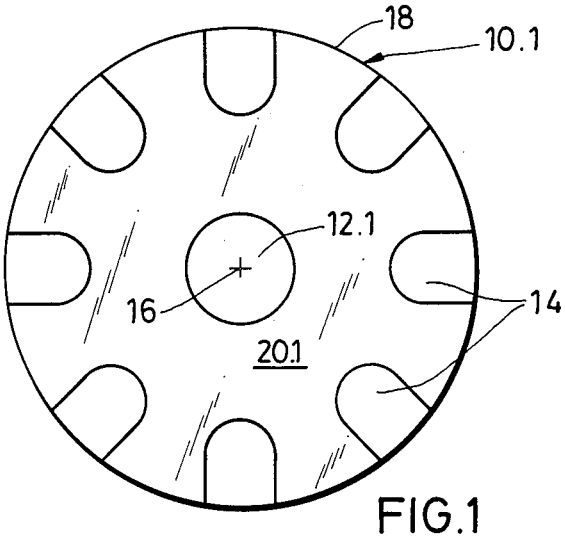
FIG. 1 shows a first embodiment of the flat disk to be used for the forming of the said improved insert.

According to FIG. 1, a flat disk 10.1 shows a region 12.1 around its center point 16, and a region 14 continuing radially from the circumference 18 towards the interior of the disk. The disk 10.1 is first hardened. Then it is soft annealized by way of localized heat input in the regions 12.1 and 14 such that a cohesive region, 20.1, between the regions 12.1 and 14, shows a greater hardness than the latter regions. The disk 10.1 is subsequently pressed into an insert which has the form of a hollow spherical cap or calotte.

The disk 10.1 can also be pressed into a hollow spherical cap or calotte in its cold hardened state, and subsequently be processed while warmed in the aforementioned manner.

If the disk consists of Armco or ingot iron, then the region 20.1 has a core hardness of approximately 130 HV and the regions 12.1 and 14 have a hardness of only 70 HV. Fortunately, the transition between the regions is not exact, but comparably progressive. This will be elaborated upon in the specifications later.

Figure 2:
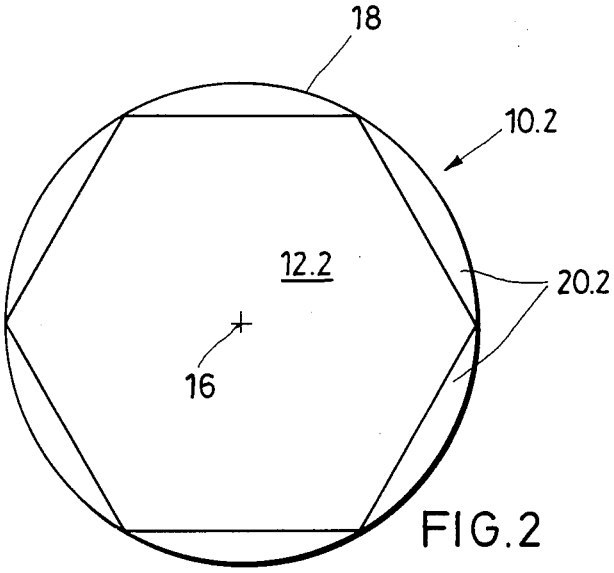
FIG. 2 shows a second embodiment of the flat disk to be used for the forming of the said improved insert.

The flat disk 10.2, in accordance with FIG. 2, is made in the following way; an annealized flat disk with an excess thickness in diameter is cold formed (cold work hardened) in the outer area by pressure. The cold formed area amounts to approximately 20% of the disk. The disk treated in this way is processed to a specified size of thickness and diameter into disk 10.2. The region 20.2, hardened by pressure, is defined on the outside by the circumference 18 and defined on the inside by the size of an inscribed equilateral hexagon of an annealized region 12.2. In an embodiment which is not pictured, the region 20.2 is defined on the inside by comparably smaller seacants over and against the region 12.2, which is itself defined on the outside by finite segments of the circumference 18. The pressure for the cold work hardening can be produced by means of two hollow stamps or presses which press on the disk from the top or the bottom, or from both sides simultaneously. In conjunction with the aforementioned processing to a specified size, the disk 10.2 is pressed for insertion into the form of a hollow sphere indentation or a calotte. This procedure, by simple means, also results in a progressive transition between the named regions by rounding off the pressure surfaces of the stamp or press or stempel in the area marked 12.2.

Figure 3:
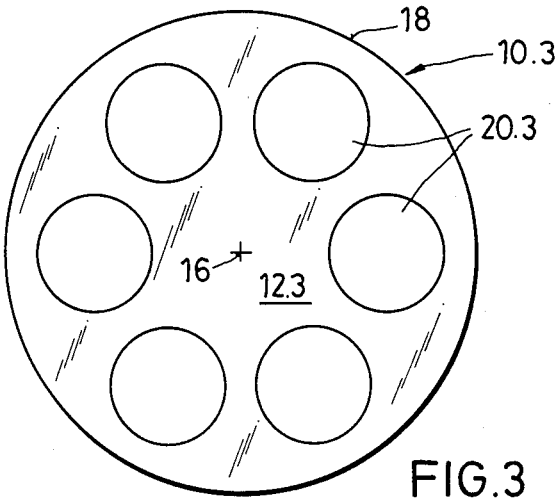
FIG. 3 shows a third embodiment of the flat disk to be used for the forming of the said improved insert.

The flat disk 10.3, of FIG. 3, is also comprised of an annealized flat disk with excess thickness and diameter. The regions 20.3 are cold formed and hardened by pressing from top or bottom by means of two stamps with projections whose front surface, at a given diameter, show a given amount of bulging. Thereby, a radial forming gradient can be set in the regions 20.3 by simple means, that is, by the formation of the front surface of the protrusions of the stamp. In this way, a comparably exact transition between the region 20.3 and the surrounding central region 12.3 is avoided. After the cold work hardening, the production to the specified size, according to thickness and diameter, results to produce the shown flat disk 10.3, which can be later pressed for insertion.

Figure 4:
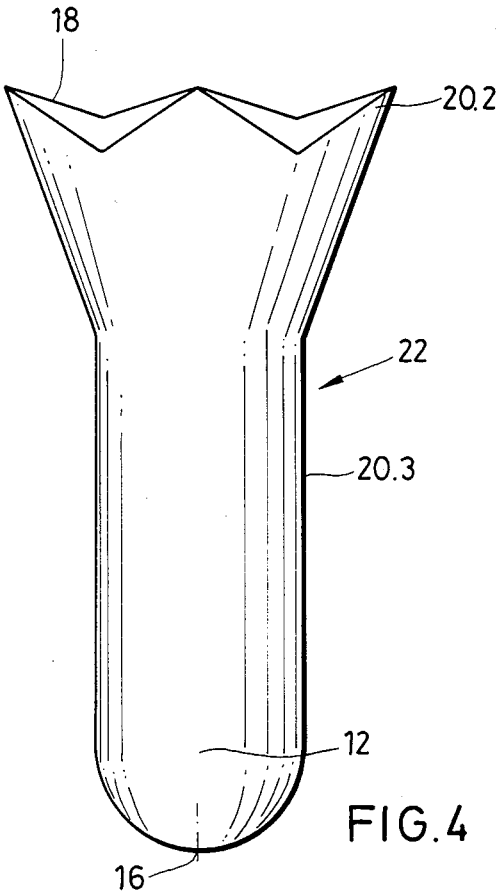
FIG. 4 shows a side sectional view of explosive projectile formed from the said improved insert.

The aforementioned steps can be varied and/or combined for achievement of a desired effect. This can be seen from FIG. 4 in which the corresponding regions of the projectile 22 are provided with the reference numbers of FIGS. 2 and 3. The greater strength serves to prevent shrinkage at 20.3 of the rod-shaped projectile body, and at 20.2 of the rear end flaring out section, allowing the aerodynamic stabilization of the projectile's flight path.

The modification of material properties of the different region of the disk by thermic and/or mechanical processing is not only easier and less costly than prior known methods, but it also enables, within broad limits, the freedom of setting design parameters of the inserts to be produced for explosive projectiles. Undesirable material separations during the explosion deformation and flight of the projectile are avoided, by means of the aforementioned progressive transition between the different regions of the said insert. The molding of the depressed insert into its final installation size (if necessary by cutting a chamfer i.e. beveling) is made comparatively easy with the inserts of the invention.

While there has been described a particular embodiment of the improved insert and a process for making the same, it will be apparent to those skilled in the art that variations may be made thereto without departing from the spirit of the invention and the scope of the appended claims.

We claim:

1. A liner, essentially of the form of a hollow spherical cap or calotte, for being arranged on the shaped front of an explosive charge, preferably of a projectile, said liner being earmarked for being collapsingly shaped on the explosion of said explosive charge in order to form a rod shaped projectile with rear end flaring out which allows for the aerodynamic stabilization of said rod shaped projectile, said liner comprising:

zones which are symmetrically arranged to the center of said liner, said zones having mechanical properties which differ from the mechanical properties of the region neighboring said zones, said difference of said mechanical properties resulting in a predetermined dynamic behavior of the material forming said liner such, that said behavior satisfies the demands which are set by said aerodynamic stabilization of said rod shaped projectile.

2. A process for the manufacture of an insert as described in claim 1, comprising;

hardening of a flat disk;

pressing the flat disk into a hollow spherical cap or calotte; and then annealizing particular outer regions.

3. A process for the manufacturing of an insert as described in claim 1, comprising;

hardening of a flat disk;

annealizing particular outer regions; and then pressing the flat disk into a hollow spherical cap or calotte.

4. A process for the manufacture of an insert as described in claim 1, comprising;

annealizing a flat disk with an excess diameter and wall thickness;

cold work hardening particular outer regions of the disk;

preparing the disk to a specified size; and finally pressing the disk into a hollow spherical cap or calotte.

5. A process according to claim 4, wherein the cold work hardening results from pressing the disk from the top side.

6. A process according to claim 4, wherein the cold work hardening results from pressing the disk from the bottom side.

7. A process according to claim 4, wherein the cold work hardening results from pressing the disk simultaneously from the top and the bottom side.

8. A process for the manufacture of an insert as described in claim 1, comprising;

annealizing a flat disk with an excess diameter and wall thickness;

cold work hardening particular outer regions of said disk by pressing the disk from the top or the bottom, or both sides simultaneously;

pressing said disk into a hollow spherical cap or calotte of a specific size.

* * * * *